United States Patent [19]

Brakhage

[11] 4,439,943

[45] Apr. 3, 1984

[54] RECOIL REDUCER

[76] Inventor: Rodney D. Brakhage, P.O. Box 245A, Rural Rte. 2, Perkins, Okla. 74059

[21] Appl. No.: 356,416

[22] Filed: Mar. 9, 1982

[51] Int. Cl.[3] ..... F41C 23/00

[52] U.S. Cl. ..... 42/74; 89/43 R

[58] Field of Search ..... 42/74; 89/43 R, 198

[56] References Cited

U.S. PATENT DOCUMENTS

| | | | |
|---|---|---|---|
| 565,607 | 8/1896 | Deport | 89/43 R |
| 837,601 | 12/1906 | Behr . | |
| 910,276 | 1/1909 | Easdale . | |
| 935,163 | 9/1909 | Parker . | |
| 1,169,050 | 1/1916 | MacKinnion . | |
| 1,307,529 | 6/1919 | Werndl . | |
| 1,454,973 | 5/1923 | Malloy, Jr. . | |
| 1,896,454 | 2/1933 | Marek . | |
| 2,182,016 | 12/1939 | Deutsch | 188/88 |
| 2,745,517 | 5/1956 | Zook | 188/88 |
| 2,754,608 | 7/1956 | Stieffel, Jr. | 42/74 |
| 2,788,842 | 4/1957 | Ohlenkamp | 155/9 |
| 2,885,220 | 5/1959 | Dalton | 280/150.5 |
| 3,039,222 | 6/1962 | Hoge | 42/74 |
| 3,233,354 | 2/1966 | Ahearn | 42/74 |
| 3,418,880 | 12/1968 | Herlach | 89/42 |
| 3,491,473 | 1/1970 | Eastin | 42/74 |
| 3,707,797 | 1/1973 | Ruth | 42/74 |

OTHER PUBLICATIONS

The drawing of Italian Patent No. 355,783.
The drawing of French Patent No. 792.113.
The drawing of French Patent No. 1,428,119.

*Primary Examiner*—Charles L. Jordan
*Assistant Examiner*—Ted L. Parr
*Attorney, Agent, or Firm*—Dunlap & Codding

[57] ABSTRACT

A recoil reducer for a shoulder firearm including a main piston that moves axially in a cylinder disposed in a cavity in the firearm stock to intersect the butt of the firearm, the main piston being connected via a piston rod to a plate that supports a shoulder pad spaced rearwardly of the butt such that major portions of the firearm can move rearwardly when the firearm is discharged. The main piston has an aperture formed therethrough, said aperture having a frusto-conical portion and a threaded portion to receive corresponding threaded and frusto-conical portions of the piston rod. A passage is formed through the main piston rod between the frusto-conical portion of said aperture and one side of the main piston to permit passage of fluid between the sides of the piston during recoil of the firearm and a spring biased follower piston is disposed in the cylinder rearwardly of the main piston to seal the cylinder against leakage of hydraulic fluid disposed in portions of the cylinder remote from the butt plate. The main piston further includes an axial bore that accepts a guide rod to prevent rotation of the main piston so that the spacing of frusto-conical portions of the piston rod and main piston aperture can be varied, to adjust the resistance to the passage of hydraulic fluid through the main piston, by turning the piston rod.

11 Claims, 5 Drawing Figures

RECOIL REDUCER

BACKGROUND OF THE INVENTION

1. Field of the Invention

The present invention relates generally to improvements in recoil reducers for firearms and, more particularly, but not by way of limitation, to recoil reducers for firearms that are fired from the shoulder.

2. Brief Description of the Prior Art

As is well known in the art, a rifle or shotgun will recoil rearwardly to give the familiar "kick" to the shoulder of the user when the firearm is discharged. Often this kick will be of a magnitude that the user of the firearm finds objectionable and, because of this, many inventors have turned their attention toward developing recoil reducers that limit the maximum thrust that the firearm exerts to the shoulder. In general, these recoil reducers permit major portions of the firearm to move relative to portions held against the user's shoulder so that the force of the recoil is spread out over a period of time rather than being delivered as a sharp blow to the shoulder.

As a result of these inventive efforts, a variety of types of recoil reducers are known. These vary in construction from simple spring systems, either mechanical or pneumatic, to relatively sophisticated devices such as the hydraulic recoil absorber disclosed in U.S. Pat. No. 3,233,354 issued Feb. 8, 1966 to Ahearn. In this latter recoil reducer, the stock of the firearm is divided into two members, a butt piece which is placed against the user's shoulder, and a forepiece which is fixed to remaining portions of the firearm. A hydraulic cylinder and piston sliding in the cylinder connect these two portions of the stock and hydraulic fluid is permitted to escape about the piston to permit relative motion between the two portions of the stock while concurrently controlling such motion to absorb the recoil.

While prior art recoil reducers, the hydraulic type in particular, can in principle be very effective recoil absorption devices, problems arise in their application. Firearms are available in a range of calibers and gauges and their recoil characteristics will vary with the type of ammunition that the firearm is designed to use. Similarly, the constuction of the individual firearm will have an effect upon its recoil characteristics; in particular, the weight of a firearm is an important factor in the way it will recoil when it is fired. Moreover, a selection of different types of ammunition will often be commercially available for a particular caliber or gauge of firearm so that the shooter can select his ammunition in accordance with the purpose for which his firearm is to be used. In addition, he may load his own ammunition to obtain particular ballistics or firing characteristics. The choice of ammunition used in a particular firearm will also have an effect upon its recoil characteristics. Since the effectiveness of a recoil reducer will be determined by the degree to which its characteristics are matched to the recoil characteristics of the firearm upon which it is mounted, these variations in the recoil characteristics have, in the past, limited the effectiveness of recoil reducers. A recoil reducer suitable for one firearm using a particular type of ammunition may, or may not, be appropriate for another firearm using the same or different ammunition.

SUMMARY OF THE INVENTION

The present invention solves the problem of recoil reducer effectiveness by providing a recoil reducer of the hydraulic type that is readily adjustable in the field. To this end, the characteristics of the recoil reducer are determined by the escape of fluid through a piston that slides in a cylinder disposed in the butt of the firearm and is connected to a plate spaced a distance to the rear of the butt via a piston rod. The piston is fixed against rotation in the cylinder and has an aperture formed therethrough to receive one end of the piston rod. Each of the piston rod and the aperture have a threaded portion and a frusto-conical portion so that the end of the piston rod can mate with the aperture and, moreover, can be moved axially in the aperture, to vary the spacing between frusto-conical portions of the aperture and piston rod, by turning the piston rod. A passage is formed through the piston to intersect one side thereof and to intersect the frusto-conical portion of the aperture in the piston so that the escape of fluid through the piston, and consequently the recoil characteristics of the recoil reducer, can be adjusted by turning the piston rod.

An object of the present invention is to provide a firearm recoil reducer that is adjustable for matching the recoil characteristics of the firearm upon which the recoil reducer is mounted.

Another object of the present invention is to provide a firearm recoil reducer that can be used effectively on a variety of firearms exhibiting differing recoil characteristics.

Still further object of the present invention is to provide a firearm recoil reducer that is adjustable for differing types of ammunition that may be used in a firearm.

Other objects, advantages and features of the present invention will become clear from the following detailed description of the preferred embodiment of the invention when read in conjunction with the drawings and appended claims.

DESCRIPTION OF THE PREFERRED EMBODIMENT

Figure 1:
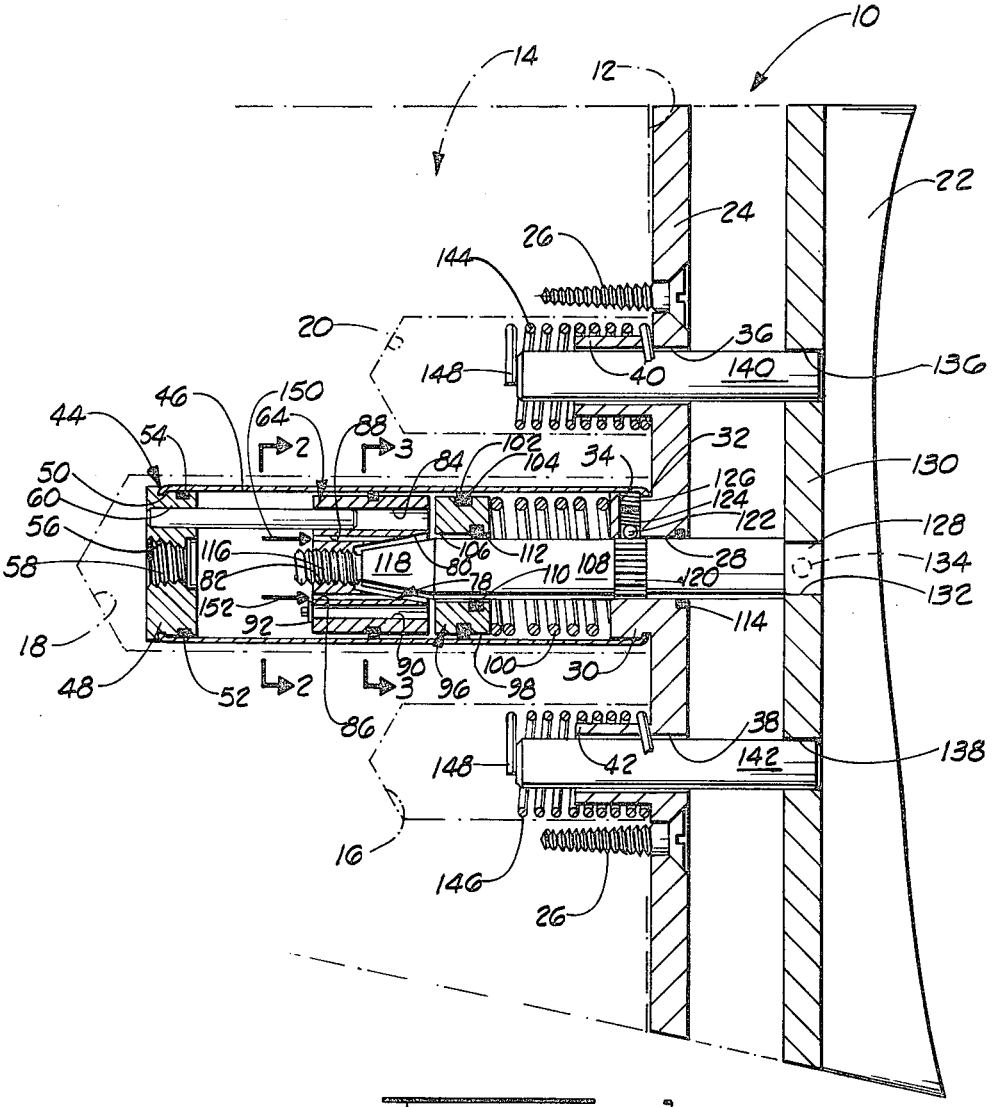
FIG. 1 is a cross-section in side elevation of the recoil reducer of the present invention.

Referring now to the drawings in general and to FIG. 1 in particular, shown therein and designated by the general reference numeral 10 is a recoil reducer constructed in accordance with the present invention. The recoil reducer 10 mounts on the butt 12 of the stock 14 of a firearm and the stock of the firearm has been indicated in phantom lines in FIG. 1. As shown therein, the recoil reducer 10 comprises elements which are disposed within the stock 14 and suitable cavities 16, 18 and 20 are formed in the stock 14 for this purpose, the cavities 16, 18 and 20 intersecting the butt 12 and extending therefrom a preselected distance into the stock 14. A portion of the recoil reducer 10, disposed rearwardly of the butt 12, can carry a butt pad 22 as has also been shown in FIG. 1.

The recoil reducer 10 generally comprises a butt plate 24 which is fixed to the butt 12 by screws 26, the butt plate 24 being shaped to have a transverse cross section substantially identical to the cross section of the stock 14 at the butt 12 thereof. The butt plate 24 has a central butt plate aperture 28 formed therethrough and a boss 30 is formed about the butt plate aperture 28, concentrically with the butt plate aperture 28, on the side of the butt plate 24 engaged by the butt 12. A circumferential groove 32 is formed about the boss 30, adjacent the butt plate 24 and a transverse bore 34 is formed through the boss 30 for purposes that will be discussed below.

In addition to the butt plate aperture 28 and boss 30, the butt plate 24 further has guide apertures 36 and 38 formed therethrough to either side of the butt plate aperture 28 and bosses 40 and 42 are formed on the side of the butt plate 24 that is engaged by the butt 12 about the guide apertures 36 and 38 respectively. The guide apertures 36 and 38 maintain the alignment of the butt pad 22 and portions of the recoil reducer 10 attached thereto during recoil of the firearm as will be discussed below.

The recoil reducer further comprises a hydraulic cylinder 44 which is comprised of a tubular housing 46 and an endwall 48 which closes one end of the housing 46. The other end of the housing 46 is closed by the boss 30 as shown in FIG. 1. The housing 46 is sized to mate with the boss 30 so that one end of the housing 46 can be placed over the boss 30 and secured thereto so that the housing 46 extends coaxially with the butt plate aperture 28 in the assembled recoil reducer 10. The endwall 48 slides into the remote end of the housing 46 to provide a chamber within the cylinder 44 into which hydraulic fluid can be introduced. Like the boss 30, the endwall 48 has a circumferential groove 50 and the housing 46 is conveniently secured to the boss 30 and endwall 48 by crimping the ends of the housing into the grooves 32 and 50. An oil tight seal is formed between the endwall 48 and the housing 46 by an O-ring 52 disposed in a circumferential groove 54 formed in portions of the circumference of the endwall 48 overlain by the housing 46 in the assembled hydraulic cylinder 44. The endwall 48 has a threaded, tapered filling hole 56 formed therethrough to permit the introduction of hydraulic fluid into the cylinder 44 and a tapered plug 58 can be screwed into the hole 56 to close the cylinder 44 after filling. In addition, a hole 60 is formed through the endwall 48, a preselected distance off center thereof as shown in FIG. 1, to receive a guide rod 62 which extends from the endwall 48 into the housing 46 toward the butt plate 24. The guide rod 62 can conveniently be constructed on a diameter to tightly fit the hole 60 so as to fix the guide rod 62 in the cylinder 44 and to prevent leakage of the hydraulic fluid from the cylinder 44 via the hole 60. The guide rod 62 is pressed into the hole 60 during the assembly of the recoil reducer 10.

Figure 2:
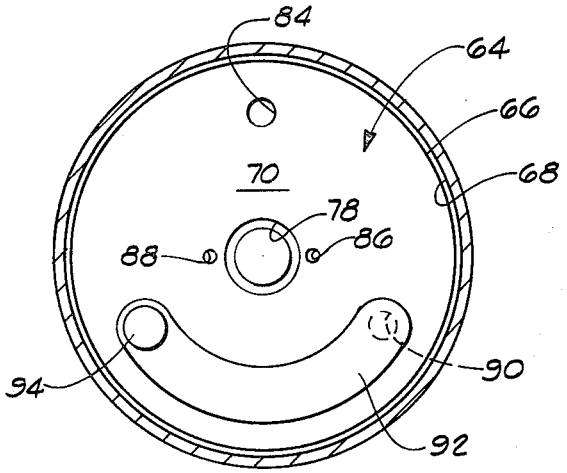
FIG. 2 is an end elevational view of the main piston of the recoil reducer taken along line 2—2 of FIG. 1.
Figure 3:
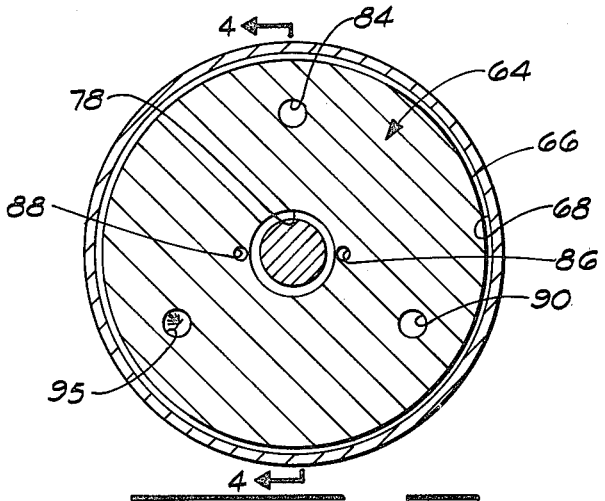
FIG. 3 is a transverse cross-section of the main piston of the recoil reducer taken along line 3—3 of FIG. 1.
Figure 4:
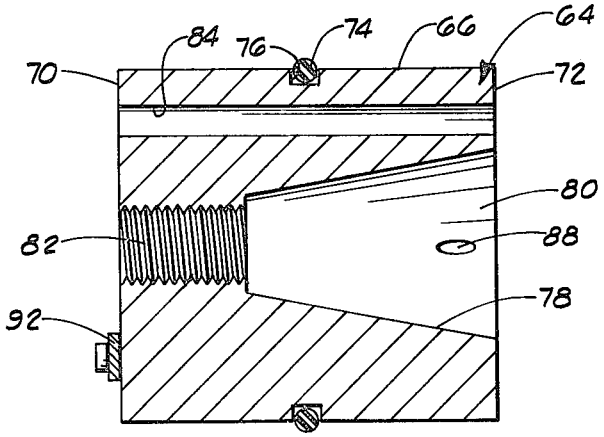
FIG. 4 is a longitudinal cross-section of the main piston taken along line 4—4 of FIG. 3.

The recoil reducer 10 further comprises a main piston 64 which is disposed within the cylinder 44 for axial movement therein and which is more particularly shown in FIGS. 2–4. As shown in these Figures, the main piston 64 is generally cylindrical in form, the main piston 64 having a cylindrical outer peripheral surface 66 sized to slide within the inner periphery 68 of the housing 46 and sides 70 and 72 facing the endwall 48 and the boss 30 respectively. An O-ring 74, disposed in a groove 76 formed in the surface 66 and extending circumferentially about the main piston 64, provides a sliding seal between the outer peripheral surface 62 of the main piston 64 and the inner peripheral surface 68 of the housing 46 to prevent passage of hydraulic fluid between the sides 70 and 72 of the main piston 64 about the peripheral surface 66 of the main piston 64.

A centrally located main piston aperture 78 is formed through the main piston 64 to intersect the sides 70 and 72 thereof, the aperture 78 extending coaxially with the peripheral surface 66 thereof so that, when the main piston 64 is disposed in cylinder 44, the main piston aperture 78 will be coaxial with the butt plate aperture 28 through the butt plate 24. As is particularly shown in FIG. 4, the main piston aperture 78 has two portions. Adjacent the end 72 which faces the butt plate 24 in the assembled recoil reducer 10, the aperture 78 has a first portion 80 having a frusto-conical peripheral surface that diverges toward the side 72 of the piston 64. A second portion 82 of the aperture 78 intersects the small end of the frusto-conical portion 80 and extends therefrom to intersect the side 70 of the main piston 64 that is remote from the butt plate 24. As shown in FIG. 4, the second portion 82 of the aperture 78 is generally cylindrical in shape and is threaded throughout its length. The purposes underlying the shaping and the placement of the main piston aperture 78 will be discussed below.

In addition to the main piston aperture 78, a plurality of passages and holes are formed in the main piston 64 along lines that parallel the axis of the main piston aperture 78 as has been indicated in FIG. 1 in which selected ones of the additional holes and passages have been illustrated in a single plane, rather than as shown in FIGS. 2–4, for purposes of describing the operation of the recoil reducer 10. As is particularly shown in FIG. 4, these additional holes and passages include a guide rod hole 84 that is displaced from the axis of the main piston aperture 78 a distance equal to the displacement of hole 60 from the axis of the endwall 48 of the hydraulic cylinder 44. The guide rod hole 84 is sized to form a sliding fit with the guide rod 62 which extends thereinto in the assembled recoil reducer 10 as shown in FIG. 1. As will be clear to those skilled in the art, the guide rod 62 will thus fix the main piston 64 against rotation in the cylinder 44 but will not interfere with axial movement of the main piston 64 in the cylinder 44.

Near the main piston aperture 78, at least one and preferably two flow passages 86 and 88 are formed through portions of the main piston 64 between the side 70 thereof remote from the butt plate 24 in the assembled recoil reducer and the frusto-conical portion 80 of the main piston aperture 78, the flow passages 86 and 88 intersecting the remote side 70 of the main piston 64 and the frusto-conical portion 80 of the main piston aperture 78 as has been indicated for the flow passage 88 in FIG. 4 and for both passages 86 and 88 in FIG. 1. (In FIG. 1, the flow passages 86 and 88 have been displaced 90 degrees about the main piston aperture 78 from the positions shown in FIGS. 2–4 for purposes of describing the operation of the recoil reducer 10 below.) The flow passages 86 and 88 permit the escape of hydraulic fluid through the main piston 64 so that the main piston 64 can move axially within the cylinder 44 toward the endwall 48 and, further, control the escape of fluid through the main piston 64 to match the recoil reducer 10 to the recoil characteristics of the firearm on which the recoil reducer 10 is mounted as will be discussed below.

As further shown in the drawings, the main piston 64 can be provided with a return port 90 that intersects the sides 70 and 72 of the main piston 64 and extends therebetween as has been indicated in FIG. 1. (As in the case of the flow passages 86 and 88, the return port 90 has been angularly displaced about the main piston aperture 78 in FIG. 1 in order to illustrate the operation of the recoil reducer 10. The placement of the return port 90 in the preferred embodiment of the invention has been shown in FIGS. 2 and 3.) The return port 90 provides an alternate path for fluid flow through the main piston 64 unidirectionally from the butt plate 24 toward the endwall 48 and, to this end, the intersection of the return port 90 with the side 70 of the main piston 64 remote from the butt plate 24 is overlaid with one end of a leaf 92 (FIG. 2) that is secured to the main piston 64 at its other end via a rivet 94 that is pressed into a blind hole 95 (FIG. 3) formed in the remote side 70 of the main piston 64. As will be clear to those skilled in the art, the leaf 92 will tightly engage the side 70 of the main piston 64, to prevent the passage of fluid through the return port 90, at such times that the endwall 48 is moved toward the main piston 64 as will occur during recoil of the stock 14. Thus, the return port 90 plays no role in the absorption of recoil by the recoil reducer 10; rather, the return port 90 has a different function which will be described below.

Returning now to FIG. 1, the recoil reducer 10 further comprises a follower piston 96 disposed within the cylinder 44 between the main piston 64 and the butt plate 24. The follower piston 96 has the form of a ring and the outer peripheral surface 98 thereof is formed on a diameter slightly smaller than the diameter of the inner peripheral surface 68 of the housing 46 so that the follower piston 96 is free to move axially in the cylinder 44. A spring 100 is positioned between the follower piston 96 and the butt plate 24 to bias the follower piston toward the main piston 64.

Portions of the cylinder 44 remote from the butt plate 24 are filled with hydraulic fluid in the assembled recoil reducer 10 and such portions are sealed by the endwall 48, as discussed above, and the follower piston 96. To this end, a groove 102 is formed in the periphery 98 of the follower piston 96 and extends circumferentially thereabout to receive an O-ring 104 that provides a sliding seal between the inner periphery 68 of the housing 46 and the periphery 98 of the follower piston 96. A type of O-ring which is particularly suited for use in the follower piston 96 is the neoprene U-cup seal manufactured by Disogrin Industries Corporation of Grenier Field, Manchester, N.H., 03103.

A bore 106 is formed through central portions of the follower piston coaxially with the periphery 98 thereof so that the bore 106 will align with the main piston aperture 78 and the butt plate aperture 28 in the assembled recoil reducer 10. A piston rod 108 passes through the bore 106 of the follower piston 96 and extends therefrom through the butt plate aperture 28. A circumferential groove 110 is formed in the bore 106 to extend about the piston rod 108 and contains an O-ring 112 that completes the sealing of portions of the cylinder 44 remote from the butt plate 24. (In addition, a rod wiper seal 114 can be formed between the piston rod 108 and the butt plate 24 to prevent foreign matter from entering the cylinder 44.)

The piston rod 108 has a reduced diameter, threaded portion 116 at one end thereof that protrudes through the bore 106 of the follower piston 96 toward the main piston aperture 78 and the threads on the portion 116 are formed to mate with the threads formed in the threaded portion 82 of the main piston aperture 78 so that the piston rod 108 can be screwed thereinto. Adjacent the threaded portion 116, the piston rod 108 has a frusto-conical portion 118 that is similarly shaped to mate with the frusto-conical portion of the main piston aperture 78. As will be clear from the above the spacing between the frusto-conical portions 80 and 118 of the main aperture 78 and piston rod 108 respectively, together with the passages 86 and 88, provides a path for fluid flow between the sides 70, 72 of the main piston 64 that damps motion of the main piston 64 by restricting such flow. Moreover, the resistance to fluid flow and consequent damping of the motion of the main piston 64 can be selectively varied by turning the piston rod to adjust the recoil reducer to match the recoil characteristics of a firearm as will be discussed below.

Portions of the piston rod 108 disposed within the boss 30 can be provided with a straight knurl 120 to provide the recoil reducer 10 with an optional click indicator assembly for facilitating the adjustment of the recoil reducer 10 for different loads of ammunition that might be used in a firearm upon which the recoil reducer 10 is mounted. As will be discussed below, adjustment of the recoil reducer 10 is accomplished by turning the piston rod 108 and the click indicator assembly indicates increments of angular adjustment of the piston rod 108. For this purpose, the click indicator assembly can comprise a ball 122 which is disposed within the bore 34 formed in the boss 30 and which is forced against the knurl 120 by a spring 124. The bore 34 is threaded to receive a set screw 126 which holds the spring 124 and ball 122 within the bore 34. Alternatively, a steel nose spring plunger, catalog number ADB-50005, manufactured by American Drill Bushing Company, 2000 Camfield Avenue, Los Angeles, Calif., 90040, can be used in place of the set screw 126, spring 124 and ball 122. As noted above, and as shown in FIG. 1, the piston rod 108 extends through the butt plate 24, the piston rod 108 terminating exteriorly of the butt plate 24 in a reduced diameter portion 128 which is spaced a preselected distance rearwardly of the butt plate 24. The recoil reducer 10 further comprises an auxiliary plate 130, upon which the butt pad 22 is mounted, the auxiliary plate 130 having an aperture 132 formed through central portions thereof to receive the end portion 128 of the piston rod 108 so that the plate 130 is spaced from the butt plate 24 by the selected protrusion of the piston rod 108 from the butt plate 24. Both the end portion 128 of the piston rod 108 and the aperture 132 are circular in cross section so that the piston rod 108 can be turned in the aperture 132 for adjustment of the recoil reducer 10 as noted above. The piston rod 108 can be secured to the auxiliary plate 130 by a set screw 134 extending through portions of the auxiliary plate 130 laterally disposed of the aperture 132 and indicated by a dashed line in FIG. 1.

In addition to the aperture 132, two additional apertures 136 and 138 are formed through the auxiliary plate 130 to either side of the aperture 132. The apertures 136 and 138 are spaced from the aperture 132 so as to align with the guide apertures, 36 and 38 respectively, formed through the butt plate 24 when the auxiliary plate is mounted on the piston rod 108. The apertures 136 and 138 are slightly smaller than the guide apertures 36 and 38 so that rods 140 and 142, of a size to slide in the guide apertures 36 and 38 respectively, can be pressed into the apertures 136 and 138 and will be held securely therein. The rods 140 and 142 prevent any turning of the auxiliary plate 130 relative to the butt plate 24 so that the angular position of the piston rod 108 relative to the butt plate 24 and the main piston 64 can be fixed by the set screw 134.

The recoil reducer 10 can further comprise optional springs 144 and 146 which are disposed in the cavities 20 and 16 respectively and each have a down turned portion 148 to engage the end of one of the rods 140 and 142. The springs 144 and 146 extend about the bosses 40 and 42 respectively and the ends thereof nearest the butt plate 24 (for clarity of illustration, such ends have been cut away in FIG. 1) are turned inwardly to enter holes (not shown) formed in the bosses 40 and 42 to secure such ends to the bosses 40 and 42.

ASSEMBLY AND MOUNTING OF THE PREFERRED EMBODIMENT

The above described construction of the recoil reducer 10 permits ready assembly of its parts in a factory environment and subsequent mounting of the recoil reducer, substantially as an unit, on the butt 12 of a firearm by the owner of the firearm or by a gunsmith. For completeness of disclosure, such assembly and mounting will now be described.

In the assembly of the recoil reducer 10, it is convenient to first form the butt plate 24, the cylinder 44 and the contents of the cylinder 44 into two assemblies that can then be mated preparatory to the introduction of hydraulic fluid into the cylinder 44. The first of these two assemblies comprises the butt plate 24, the piston rod 108, the main piston 64, the follower piston 96 and the spring 100. The assembly of this grouping of components begins with the introduction of the threaded portion 116 of the piston rod 108 through the frusto-conical portion 80 of the main piston aperture 78 and into the threaded portion 82 of the aperture 78 into which the threaded portion 116 of the piston rod 108 is screwed. As will be seen in FIG. 1, the threaded portion 116 of the piston rod 108 is of a length to protrude from the main piston 64 at the end 70 thereof and such protrusion is utilized to prevent the piston rod 108 from being inadvertently unscrewed from the main piston 64 by the user of the recoil reducer 10. For this purpose, the outermost thread on the piston rod 108 is flattened subsequent to the assembly of the piston rod 108 to the main piston 64.

Following the mounting of the main piston 64 on the piston rod 108, the follower piston 96, spring 100 and butt plate 24 are sequentially placed on the piston rod 108, from the reduced end portion 128 thereof, the parts forming this first grouping of components thereby being assembled shown in FIG. 1. Where the click indicator assembly comprised of the ball 122, spring 124 and set screw 126 is incorporated into the recoil reducer 10, such assembly is introduced into the bore 34 through the boss 30 following the assembly of this first group of components of the recoil reducer 10.

The second major grouping of components comprises the housing 46, the endwall 48 and the guide rod 62. This grouping is assembled by pressing the guide rod 62 into the hole 60 formed through the endwall 48 and then inserting the endwall 48 into one end of the housing 46 and crimping such end of the housing 46 into the groove 50 extending about the endwall 48. Thereafter, the two groupings of components are mated by moving the housing 46 over the main piston 64, the follower piston 96, the spring 100 and the boss 30 so that the end of the housing opposite the endwall 48 abuts the butt plate 24. During such movement of the housing 46 over these other components of the recoil reducer 10, the housing 46 is turned so that the guide rod 62 enters the guide rod hole 84 in the main piston 64. Following the placement of the housing 46 over these other components of the recoil reducer 10, the end of the housing 46 abutting the butt plate 24 is crimped into the groove 34 in the boss 30 to form the two groupings of components into a single unit. The end of the cylinder 44 remote from the butt plate 24 is then filled with hydraulic fluid via the filling hole 56 and the cylinder is closed by screwing the plug 58 into the hole 56. The springs 144 and 146 are then mounted on the bosses 40 and 42 and secured thereto as described above.

The auxiliary plate 130 is similarly separately grouped with the rods 140 and 142 by pressing the rods 140 and 142 into the apertures 136 and 138 for later assembly with remaining portions of the recoil reducer 10 by the user. Such assembly is carried out by inserting the rods 140 and 142 into the guide apertures 36 and 38, moving the auxiliary plate 130 toward the butt plate 24 so that the reduced end portion 128 of the piston rod 108 enters the aperture 132 and the auxiliary plate 130, and then tightening the set screw 134.

For purposes of mounting the recoil reducer 10 on a firearm, the user can be provided with a template having appropriately sized holes formed therethrough at position corresponding to the positions of the bosses 30, 40 and 42 on the butt plate 24. The holes in the template corresponding to the bosses 30, 40 and 42 respectively are made substantially the same sizes as the desired diameters of the cavities 18, 20 and 16 respectively in order that the user can drill appropriately sized holes into the butt of his firearm to receive portions of the recoil reducer to be disposed in the cavities 16, 18 and 20 as shown in FIG. 1.

OPERATION OF THE PREFERRED EMBODIMENT

Figure 5:
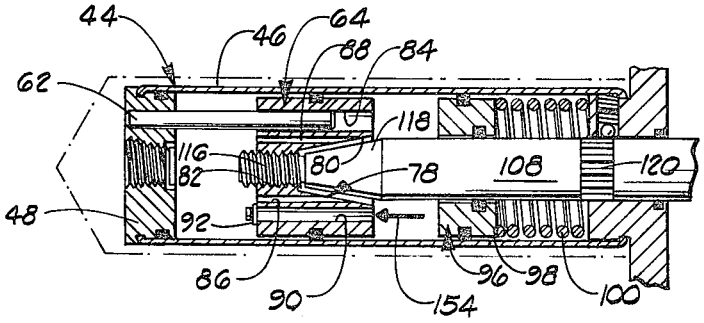
FIG. 5 is a cross section of a portion of the recoil reducer showing the positions of the components thereof subsequent to firing of a firearm on which the recoil reducer is mounted.

FIGS. 1 and 5 illustrate two different configurations of the recoil reducer 10 during operation thereof when a firearm, upon which the recoil reducer 10 is mounted, is discharged. Initially; that is, at the beginning of the recoil of the firearm, the components of the recoil reducer 10 will be positioned as has been shown in FIG. 1. As a result of discharging the firearm, the stock 14 will commence a rearward movement toward the shooters shoulder so that the butt plate 24 moves toward the auxiliary plate 130. Such movement tends to compress the hydraulic fluid in portions of the cylinder 44 adjacent the endwall 48 thereof with the result that the hydraulic fluid will be forced into the passages 86 and 88 as has been indicated by the arrows 150 and 152 in FIG. 1. The fluid that enters the passages 86 and 88 is transmitted to the spacing between the frusto-conical portion 80 of the main piston aperture 78 and the frusto-conical portion 118 of the piston rod 108 and such fluid then escapes to portions of the cylinder 44 between the main piston 64 and the follower piston 96. Since the available cross sectional area of the cylinder 44 between the pistons 64 and 96 is reduced, relative to the cross sectional area of the cylinder 44 between the main piston 64 and the endwall 48, by the piston rod 108, the passage of hydraulic fluid through the main piston 64 as the stock 14 moves rearwardly forces the follower piston toward the butt plate 24 to compress the spring 100. Such compression of the spring 100 and displacement of the follower piston 96 toward the butt plate 24 will continue until the force exerted on the follower piston 96 by the spring 100 balances the pressure of hydraulic fluid within the cylinder 44 caused by the recoil, a condition that has been illustrated in FIG. 5. (As will be clear to those skilled in the art the springs 144 and 146 will also give rise to forces tending to position the auxiliary plate 130 relative to the butt plate 28. However, the springs 144 and 146 merely augment the action of the spring 100 so that the effect of the springs 144 and 146 need not be considered. Rather, the effect of the springs 144 and 146 has been included herein in the description of the action of the spring 100.) At the point that the follower piston 96 comes to rest relative to the butt plate 24, the spring 100 will begin to expand to force the follower piston 96 toward the main piston 64 to return the firearm to battery. That is, the hydraulic fluid is forced back through the main piston 64 to return the recoil reducer 10, stock 14 and butt pad 22 to the positions shown in FIG. 1.

The return port 90 provides the recoil reducer 10 with a rapid return to battery capability. While hydraulic fluid can return to portions of the cylinder 44 between the main piston 64 and the endwall 48 via the passages 86 and 88 and the spacing between the frusto-conical portions of the main piston aperture 78 and the piston rod 108, such return will be slowed by the resistance to flow through the passages 86 and 88 and the spacing between these frusto-conical surfaces appropriate for bringing the recoiling firearm to rest. The return port 90 provides an alternate route for return of hydraulic fluid which is not subject to such resistance so that the recoil reducer 10 is rapidly returned to the condition shown in FIG. 1 for subsequent use of the firearm. That is, the return of the firearm to battery occurs by the movement of fluid through the return port 90 as indicated by the arrow 154 in FIG. 5, the fluid moving through the port 90 displacing the leaf 92 outwardly from the side 70 of the main piston 64 to reenter portions of the cylinder 44 between the main piston 64 and the endwall 48.

An important aspect of the present invention resides in the resistance to fluid flow through the main piston 64 and the relationship of such resistance to the halting of the displacement of the follower piston 96 by the spring 100. Where the resistance to fluid flow through the main piston 64 is large, the passage of fluid through the main piston 64 will occur relatively slowly so that little relative movement of the butt plate 24 and auxiliary plate 130 will occur during recoil of the firearm. As a result, a large portion of the rearward thrust of the firearm can be transmitted through the recoil reducer 10 to the butt pad 22 and, thence, to the shoulder of the shooter. On the other hand, where the resistance to fluid flow through the main piston 64 is relatively small, the follower piston 96 can be moved rapidly to a position in which the spring 100 is fully compressed with the result that the rearward thrust of the firearm is subsequently transmitted to the shoulder of the shooter. Moreover, the occurance of one or the other of these two extremes is a function of the recoil characteristics of the firearm as determined in part by the type of ammunition that the shooter might be using. For example, for a particular resistance to fluid flow through the main piston 64, the likelihood of maximum compression of the spring prior to the completion of recoil and of subsequent transmittal of an objectionable kick to the shooter's shoulder increases with increasing power of the ammunition used in the firearm. Similarly, where the power of the ammunition is insufficient to cause full compression of the spring for a particular resistance to fluid flow through the main piston 64, the effectiveness of the recoil absorption, at such particular fluid flow resistance, decreases with lighter ammunition loads because the recoil will be completed during a time in which only a small amount of fluid is passed between the two sides of the main piston.

The present invention enables the shooter to achieve maximum effectiveness of recoil absorption for substantially any type of firearm and ammunition without becoming subjected to the possibility of a large kick resulting from full compression of the spring 100 by the adjustment capability for the resistance of fluid flow through the main piston 64 that is provided by the structures and connection of the main piston 64 and piston rod 108. By loosening the set screw 134, the shooter can turn the piston rod 108 to vary the spacing between the frusto-conical portions 80 and 118 of the main piston aperture 78 and the piston rod 108 and, consequently, vary the resistance to fluid flow through the main piston 64. In particular, since the main piston 64 is fixed against rotation in the cylinder 44 by the guide rod 62, turning the piston rod 108 moves the piston rod 108 axially in the main piston aperture 78 via the connection between the piston rod 108 and main piston 64 provided by the threaded portions 82 and 116 of the main piston aperture 78 and piston rod 108 respectively to cause a corresponding axial movement of the frusto-conical portion 118 of the piston rod 108 in the frusto-conical portion 80 of the main piston aperture 78. Thus, the recoil reducer 10 can be adjusted, by turning the piston 108, such that its recoil absorption characteristics can be matched to the recoil characteristics of the firearm with which it is used and is further adjustable for different types of ammunition that might be used with such firearm.

It is clear that the present invention is well adapted to carry out the object and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. In a recoil reducer for a shoulder firearm, said recoil reducer being of the type mounted on the butt of the firearm and including a hydraulic cylinder, a main piston disposed in the hydraulic cylinder for axial movement therein during recoil of the firearm, a piston rod connected to the main piston and extending therefrom to a plate spaced a distance rearwardly of the firearm butt, and damping means for providing a restricted passage of hydraulic fluid in the cylinder from one side of the main piston to the other side thereof, the improvement wherein the main piston is characterized as having a main piston aperture formed axially therethrough, a portion of the main piston aperture having a frusto-conical surface diverging to one side of the main piston and having a threaded portion extending axially from the small end of the frusto-conical portion, and wherein the damping means comprises:

means for fixing the main piston against rotation in said cylinder:

a portion of said piston rod including a frusto-conical portion and an adjacent threaded portion, said portions of the piston rod shaped to mate with the frusto-conical and threaded portions of the main piston aperture, wherein the piston rod is connected to the main piston via the threaded portions of the piston rod and main piston aperture whereby the spacing between the frusto-conical portions of the piston rod and the main piston aperture can be varied by turning the piston rod, and wherein a flow passage is formed through the main piston to intersect the frusto-conical portion of the main piston aperture and extend therefrom to the side of the main piston opposite the side adjacent the frusto-conical portion of the main piston aperture.

2. The recoil reducer of claim 1 further comprising return port means for transmitting fluid through the main piston unidirectionally in a direction opposite the direction of recoil of the firearm.

3. The recoil reducer of claim 2 wherein the cylinder is characterized as having an endwall facing one side of the main piston opposite the side of the main piston from which the piston rod extends to said plate and wherein the return port means is characterized as comprising a leaf mounted on said one side of the piston and secured thereto at one end of said leaf, the return port being formed through the main piston and overlaid at said one side of the main piston by the other end of said leaf.

4. The recoil reducer of claim 1, 2 or 3 further comprising means for indicating increments of rotation of the piston rod.

5. A recoil reducer for a shoulder firearm, comprising:

a butt plate adapted for mounting on the butt of the firearm and having a butt plate aperture formed therethrough;

a hydraulic cylinder mounted on one side of the butt plate about said aperture and extending therefrom into a cavity formed in the stock of the firearm;

a main piston slidably disposed in the cylinder, the main piston having a peripheral surface slidingly sealed to the inner surface of the hydraulic cylinder and opposed sides intersecting the peripheral surface of the main piston and extending across the hydraulic cylinder;

a piston rod connected to the main piston and extending therefrom through the butt plate aperture;

a follower piston disposed between the main piston and the butt plate, the follower piston having a bore formed therethrough through which the piston rod extends;

means for urging the follower piston toward the main piston;

an auxiliary plate positioned rearwardly of the butt plate with respect to the butt of the firearm and spaced a distance from the butt plate; and means for securing the end of the piston rod remote from the main piston to the auxiliary plate;

wherein the recoil reducer is characterized as having means formed in part on the main piston for providing a fluid flow path of selectively variable resistance between the sides of the main piston comprising:

spaced, coaxial, frusto-conical surfaces formed on the piston rod and in a main piston aperture formed in the main piston, the frusto-conical surface formed in the main piston intersecting one side of the main piston and communicated with the other side of the main piston via at least one flow passage formed through the main piston to intersect said other side of the main piston and the frusto-conical surface formed therein; and means for adjusting the spacing between said frusto-conical surfaces.

6. The recoil reducer of claim 5 wherein the means for adjusting the spacing between the frusto-conical surfaces of the piston rod and the main piston aperture comprises:

a threaded portion of the piston rod adjacent the frusto-conical surface thereof;

a threaded portion of the main piston aperture adjacent the frusto-conical surface thereof for receiving the threaded portion of the piston rod; and means for fixing the main piston against rotation in the hydraulic cylinder, whereby the piston rod can be turned to adjust the spacing between said frusto-conical surfaces.

7. The recoil reducer of claim 6 wherein a guide rod hole is formed through the main piston parallel to the axis of the main piston and the means for fixing the main piston against rotation in the cylinder comprises a guide rod fixed to the cylinder and extending into the guide rod hole.

8. The recoil reducer of claim 6 further comprising means for indicating increments of rotation of the piston rod.

9. The recoil reducer of claim 5 further comprising means for providing a unidirectional path for fluid flow through the main piston toward the side thereof remote from said butt plate.

10. The recoil reducer of claim 9 wherein a return port is formed through the main piston to intersect said sides of the main piston and wherein the means for providing a unidirectional path for fluid flow through the main piston comprises a leaf secured at one end thereof to said remote side of said piston, the other end of said leaf overlaying the opening of said remote side to the piston into the return port.

11. A recoil reducer for a shoulder firearm, comprising:

a butt plate adapted for mounting on the butt of the firearm and having a butt plate aperture formed therethrough;

a hydraulic cylinder mounted on one side of the butt plate about said aperture and extending therefrom into a cavity formed in the stock of the firearm, a main piston slidably disposed in the cylinder, the main piston having a peripheral surface slidingly sealed to the inner surface of the hydraulic cylinder and opposed sides intersecting the peripheral surface of the main piston and extending across the hydraulic cylinder;

a piston rod connected to the main piston and extending therefrom through the butt plate aperture;

a follower piston disposed between the main piston and the butt plate, the follower piston having a bore formed therethrough through which the piston rod extends;

means for urging the follower piston toward the main piston;

an auxiliary plate positioned rearwardly of the butt plate with respect to the butt of the firearm and spaced a distance from the butt plate; and means for securing the end of the piston rod remote from the main piston to the auxiliary plate;

wherein the recoil reducer is characterized as having means formed in part on the main piston for providing a fluid flow path of selectively variable resistance between the sides of the main piston; wherein a return port is formed through the main piston to intersect the sides thereof; and wherein the recoil reducer further comprises a leaf secured at one end thereof to the side of the piston remote from the butt plate, the other end of the leaf overlaying the opening of said remote side of the main piston into the return port to provide a unidirectional path for fluid flow through the main piston toward said remote side thereof.

* * * * *